US009863123B2

(12) United States Patent
Kaneta et al.

(10) Patent No.: US 9,863,123 B2
(45) Date of Patent: Jan. 9, 2018

(54) CONSTRUCTION MACHINE

(71) Applicants: Hitachi Construction Machinery Co., Ltd., Tokyo (JP); Takako Satake, Ishioka (JP)

(72) Inventors: Tomoaki Kaneta, Kasumigaura (JP); Kouji Ishikawa, Kasumigaura (JP); Hidetoshi Satake, Ishioka (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/915,301

(22) PCT Filed: Jan. 6, 2015

(86) PCT No.: PCT/JP2015/050190
§ 371 (c)(1),
(2) Date: Feb. 29, 2016

(87) PCT Pub. No.: WO2015/125503
PCT Pub. Date: Aug. 27, 2015

(65) Prior Publication Data

US 2016/0348340 A1 Dec. 1, 2016

(30) Foreign Application Priority Data

Feb. 20, 2014 (JP) ..... 2014-031031

(51) Int. Cl.
*E02F 9/12* (2006.01)
*E02F 9/26* (2006.01)
(Continued)

(52) U.S. Cl.
CPC ..... *E02F 9/123* (2013.01); *E02F 3/32* (2013.01); *E02F 3/435* (2013.01); *E02F 9/265* (2013.01);
(Continued)

(58) Field of Classification Search
CPC ... E02F 9/123; E02F 9/265; E02F 3/32; E02F 3/435; F15B 21/08; F15B 11/08;
(Continued)

(56) References Cited

U.S. PATENT DOCUMENTS

2013/0011233 A1* 1/2013 Watanabe ..... E02F 9/123 414/744.2
2014/0199148 A1* 7/2014 Imura ..... E02F 9/123 414/687
(Continued)

FOREIGN PATENT DOCUMENTS

JP 59126829 A 7/1984
JP 62196252 U 12/1987
(Continued)

OTHER PUBLICATIONS

International Preliminary Report on Patentability (PCT/IB/338 & PCT/IB/373) issued in PCT Application No. PCT/JP2015/050190 dated Sep. 1, 2016, including English translation of Written Opinion (PCT/ISA/237) (five (5) pages).

*Primary Examiner* — Russell Frejd
(74) *Attorney, Agent, or Firm* — Crowell & Moring LLP

(57) ABSTRACT

A construction machine is characterized by including: a track structure 10; a swing structure 20 provided on the track structure 10 in a swingable manner; swing motors 25, 27 that drive and swing the swing structure; a boom 31 connected to the swing structure 20; a boom cylinder 32 that moves the boom 31 vertically; a swing operation system 72 that instructs a swing operation of the swing structure 20; a boom operation system 78 that instructs a vertical movement of the boom 31; a detector **74*d* that detects a bottom pressure of the boom cylinder 32; and a controller 80 that reduces swing speed of the swing structure 20 according to a signal from the detector 74*d*** with respect to a reference swing speed according to a signal of the swing operation, while signals
(Continued)

of the swing operation and a boom raising operation are being inputted. This ensures that a load acting on the boom can be felt on the basis of motion of a front work implement, and, on the other hand, the front work implement can be operated along a locus according to operation without being affected by the load on the boom.

5 Claims, 13 Drawing Sheets

(51) Int. Cl.

| | |
|---|---|
| ***E02F 3/32*** | (2006.01) |
| ***E02F 3/43*** | (2006.01) |
| ***F15B 21/08*** | (2006.01) |
| ***F15B 13/04*** | (2006.01) |
| ***F15B 11/08*** | (2006.01) |

(52) U.S. Cl.
CPC ..... *F15B 11/08* (2013.01); *F15B 13/0401* (2013.01); *F15B 21/08* (2013.01); *F15B 2211/205* (2013.01); *F15B 2211/6313* (2013.01); *F15B 2211/7053* (2013.01); *F15B 2211/7058* (2013.01); *F15B 2211/7128* (2013.01)

(58) Field of Classification Search
CPC ..... F15B 13/0401; F15B 2211/6313; F15B 2211/7053; F15B 2211/205; F15B 2211/7128; F15B 2211/7058
See application file for complete search history.

(56) References Cited

U.S. PATENT DOCUMENTS

2016/0003266 A1* 1/2016 Imura ..... E02F 9/2095 60/418
2016/0298313 A1* 10/2016 Amano ..... E02F 9/123
2016/0312440 A1* 10/2016 Izumi ..... E02F 9/2095

FOREIGN PATENT DOCUMENTS

JP 2008224039 A 9/2008
JP 2011038298 A 2/2011

* cited by examiner

Fig. 13

| Boom raising operation | Swing operation | Regeneration (power generation) |
|---|---|---|
| × (not conducted) | × | × |
| ○ (conducted) | × | × |
| × | ○ | × |
| ○ | ○ | ○ |

CONSTRUCTION MACHINE

TECHNICAL FIELD

The present invention relates to a construction machine, such as a hydraulic excavator, that includes a work implement capable of vertical movement and a swing structure.

BACKGROUND ART

In general construction machines, when a work load increases, a pump pressure rises and the delivery flow rate of the pump decreases. As a result, during the time when a front work implement is operated, the speed of the front work implement is lower as the work load is higher.

On the other hand, there is a construction machine in which the aperture area of an operation valve is varied by pressure compensating means in accordance with a differential pressure across the operation valve and an operation amount (see, for example, Patent Document 1). In this construction machine, for example in the case of a swing and boom raising operation for simultaneously performing swinging and boom raising, if boom load is high, the aperture area of an operation valve corresponding to the swing operation is reduced whereas the aperture area of an operation valve corresponding to the boom is increased, whereby an operability similar to that when boom load is low is secured.

PRIOR ART DOCUMENT

Patent Document

Patent Document 1: JP-2008-224039-A

SUMMARY OF THE INVENTION

Problems to be Solved by the Invention

It is a merit that a constant operability is secured independently of load. On the other hand, however, it is natural on an operation feeling basis that the moving speed of a boom is lowered when the boom load is higher. Thus, some operators prefer an operation that permits a load acting on the boom to be felt. Even in the construction machine of above-mentioned Patent Document 1, omission of the pressure compensating means ensures that the boom speed is lowered according to the boom load and, accordingly, the boom load can be felt. In that case, however, the following problem is generated at the time of a swing and boom raising operation.

For example, when a load on a boom varies, the rising speed of the boom varies even if the boom raising operation amount is the same. On the other hand, if the swing operation amount is the same, the swing speed varies little even when the load on the boom varies. In other words, even if operations seem to be conducted in the same manner, the rising amount of the boom per time differs depending on the boom load; therefore, the locus of a front work implement at the time of a swing and boom raising operation varies depending on whether the boom load is low or high. As a result, if the same swing and boom raising operation as that in the case of a low boom load is conducted in the case of a high boom load, the boom would be moved along an unexpectedly lower locus, so that the front work implement would possibly collide against a carrier of a dump truck. In addition, while the load on a boom can vary unexpectedly according to operating situations, a highly skillful ability is required to control the locus of the front work implement at the time of a swing and boom raising operation to be normally constant, independently of the boom load.

The present invention has been made in consideration of the above-mentioned circumstances. Accordingly, it is an object of the present invention to provide a construction machine that enables a load acting on a boom to be felt on the basis of motion of a front work implement and, on the other hand, enables the front work implement to be moved along a locus according to operation without being affected by the boom load.

Means for Solving the Problem

In order to achieve the above object, according to the present invention, there is provided a construction machine including: a track structure; a swing structure provided on the track structure in a swingable manner; a swing motor that drives and swings the swing structure; a boom connected to the swing structure; a boom cylinder that moves the boom vertically; a swing operation system that instructs a swing operation of the swing structure; a boom operation system that instructs a vertical movement of the boom; a detector that detects a state quantity varying according to a load on the boom cylinder; and a controller that reduces swing speed of the swing structure according to a signal from the detector with respect to a reference swing speed according to a signal of the swing operation, while signals of the swing operation by the swing operation system and a boom raising operation by the boom operation system are being inputted, wherein the controller includes: a boom speed reduction calculation section configured to calculate a boom speed reduction amount $\Delta R$ with respect to a reference boom raising speed Rs that is suited to an operation amount of the boom operation system on the basis of the signal from the detector; a swing speed reduction amount calculation section configured to calculate a swing speed reduction amount $\Delta S$ with respect to a reference swing speed Ss that is suited to operation amount of the swing operation system on the basis of the operation amount of the swing operation system and the boom speed reduction amount $\Delta R$; and a torque command calculation section configured to calculate and output a swing motor torque command for generating the swing speed reduction amount $\Delta S$ on the basis of swing torque of the swing motor and the swing speed reduction amount $\Delta S$, and wherein the swing speed reduction amount calculation section calculates the swing speed reduction amount $\Delta S$ such that the relation of $(Rs-\Delta R)/(Ss-\Delta S)=Rs/Ss$ is established.

Effect of the Invention

According to the present invention, a load acting on a boom can be felt on the basis of motion of a front work implement and, on the other hand, the front work implement can be moved along a locus according to operation without being affected by the boom load. Consequently, enhancement of operability and safety can be expected.

BRIEF DESCRIPTION OF THE DRAWINGS

FIG. 13 is a chart summarizing conditions for suppressing swing speed in the construction machine according to the first embodiment of the present invention.

MODES FOR CARRYING OUT THE INVENTION

Embodiments of the present invention will be described below, using the drawings.

First, a swing and boom raising operation herein means to simultaneously perform a boom raising operation and a swing operation, namely, a situation wherein an input for the boom raising operation and an input for the swing operation overlap each other on a time basis. Therefore, while it is needless to say that a case wherein both the operations are the same as to starting timing and finishing timing is included in the swing and boom raising operation, the period of time during which both the operations are performed in such cases as a case wherein one of operation inputs precedes the other of the operation inputs but wherein the other of the operation inputs is conducted during the time when one of the operation input is continuing is also included in the swing and boom raising operation.

First Embodiment

Figure 1:
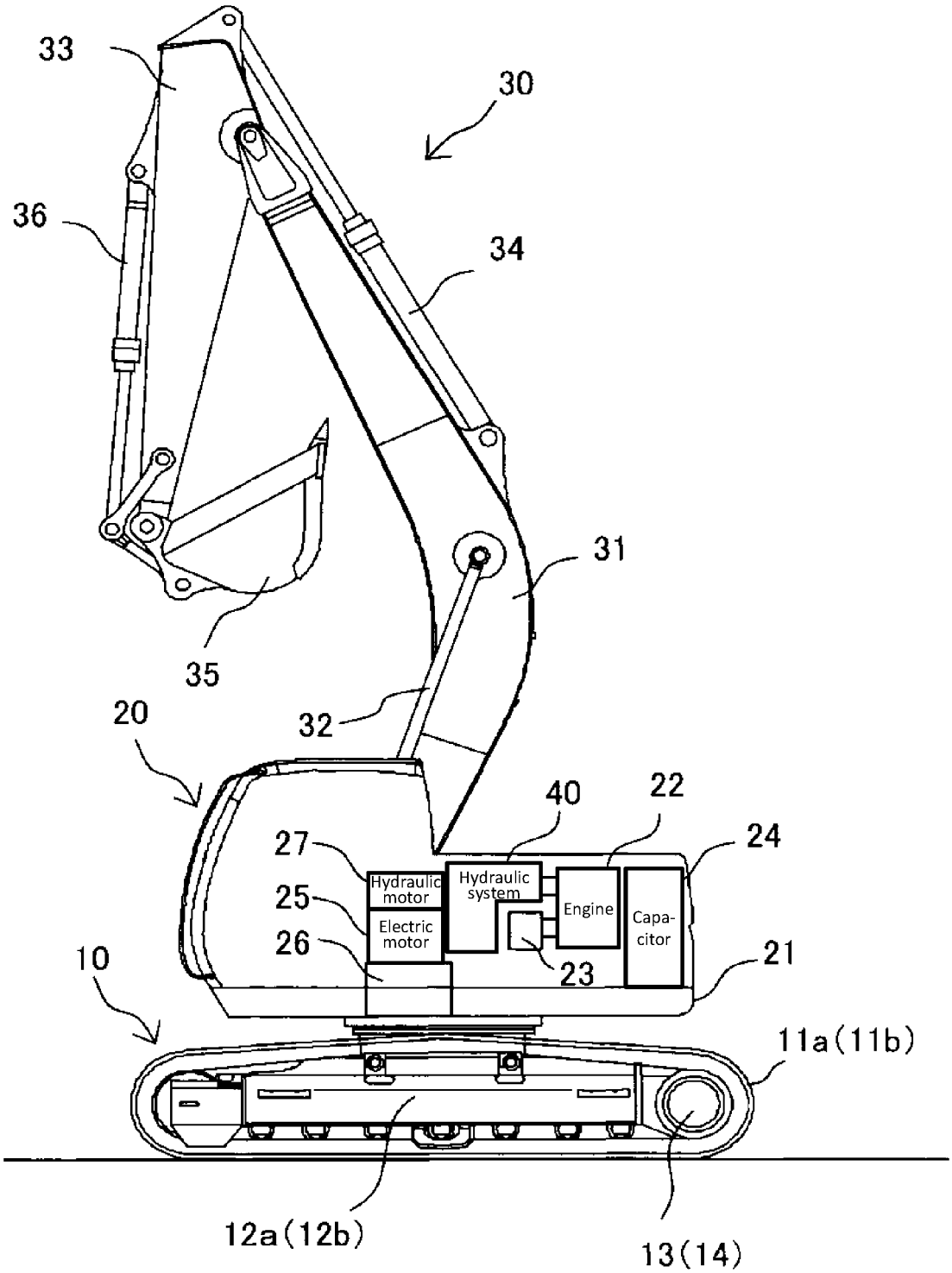
FIG. 1 is a partial perspective side view of a construction machine according to a first embodiment of the present invention.

FIG. 1 is a partial perspective side view of a construction machine according to a first embodiment of the present invention.

The construction machine illustrated in FIG. 1 is an electrically driven type hydraulic excavator, which includes a track structure 10, a swing structure 20 provided on the track structure 10 in a swingable manner, and an excavator mechanism (front work implement) 30 provided on the swing structure 20 in a vertically movable manner.

The track structure 10 includes: a pair of left and right crawlers 11*a* and 11*b*; a pair of left and right crawler frames 12*a* and 12*b;* traveling hydraulic motors 13 and 14 for driving the left and right crawlers 11*a* and 11*b* respectively; and speed reduction gears for the traveling hydraulic motors 13 and 14, etc. Of the crawlers 11*a* and 11*b* and the crawler frames 12*a* and 12*b,* only those ones on the left side are shown in FIG. 1.

The swing structure 20 is mounted on upper portions of the crawler frames 12*a* and 12*b* through a swing frame 21. The swing frame 21 is provided on upper portions of the crawler frames 12*a* and 12*b* through a swing ring in such a manner as to be swingable about a vertical axis. Though not specifically illustrated, the swing ring includes an inner ring connected to the crawler frames 12*a* and 12*b,* and an outer ring connected to the swing frame 21, the outer ring being swingable in relation to the inner ring. Over the swing frame 21, there are provided a swing electric motor 25 and a swing hydraulic motor 27. The swing electric motor 25 is supported by the outer ring of the swing ring together with the swing hydraulic motor 27, and has an output shaft meshed with an internal gear of the inner ring through a speed reduction gear 26. The swing hydraulic motor 27 is provided coaxially with the swing electric motor 25. In addition, a capacitor 24 as an electricity accumulation device is connected to the swing electric motor 25, and the swing electric motor 25 is driven by supply of electric power from the capacitor 24. Owing to this configuration, driving forces of the swing hydraulic motor 27 and the swing electric motor 25 are transmitted to the swing ring through the speed reduction gear 26, and the swing structure 20 is swung together with the swing frame 21 in relation to the track structure 10.

The excavator mechanism 30 is a front work implement of an articulated structure including a boom 31, an arm 34, and a bucket 35. The boom 31 is connected to the swing frame 21 of the swing structure 20 by a pin or the like in a vertically movable manner. The arm 34 is connected to a tip portion of the boom 31 by a pin or the like so that it can be rotated in forward-rearward directions. The bucket 35 is connected to a tip portion of the arm 34 by a pin or the like in a rotatable manner. The boom 31, the arm 34 and the bucket 35 are driven by a boom cylinder 32, an arm cylinder 34 and a bucket cylinder 36, respectively. The boom cylinder 32, the arm cylinder 34 and the bucket cylinder 36 are hydraulic cylinders.

Besides, a drive system for driving various actuators is mounted on the swing frame 21. The drive system includes a hydraulic system 40 for driving hydraulic actuators, and an electric system for driving electric actuators. The hydraulic system 40 drives the aforementioned traveling hydraulic motors 13 and 14, the swing hydraulic motor 27, the boom cylinder 32, the arm cylinder 34, the bucket cylinder 36 and the like. The electric system drives the an assist power generation motor 23, the swing electric motor 25 and the like.

Figure 2:
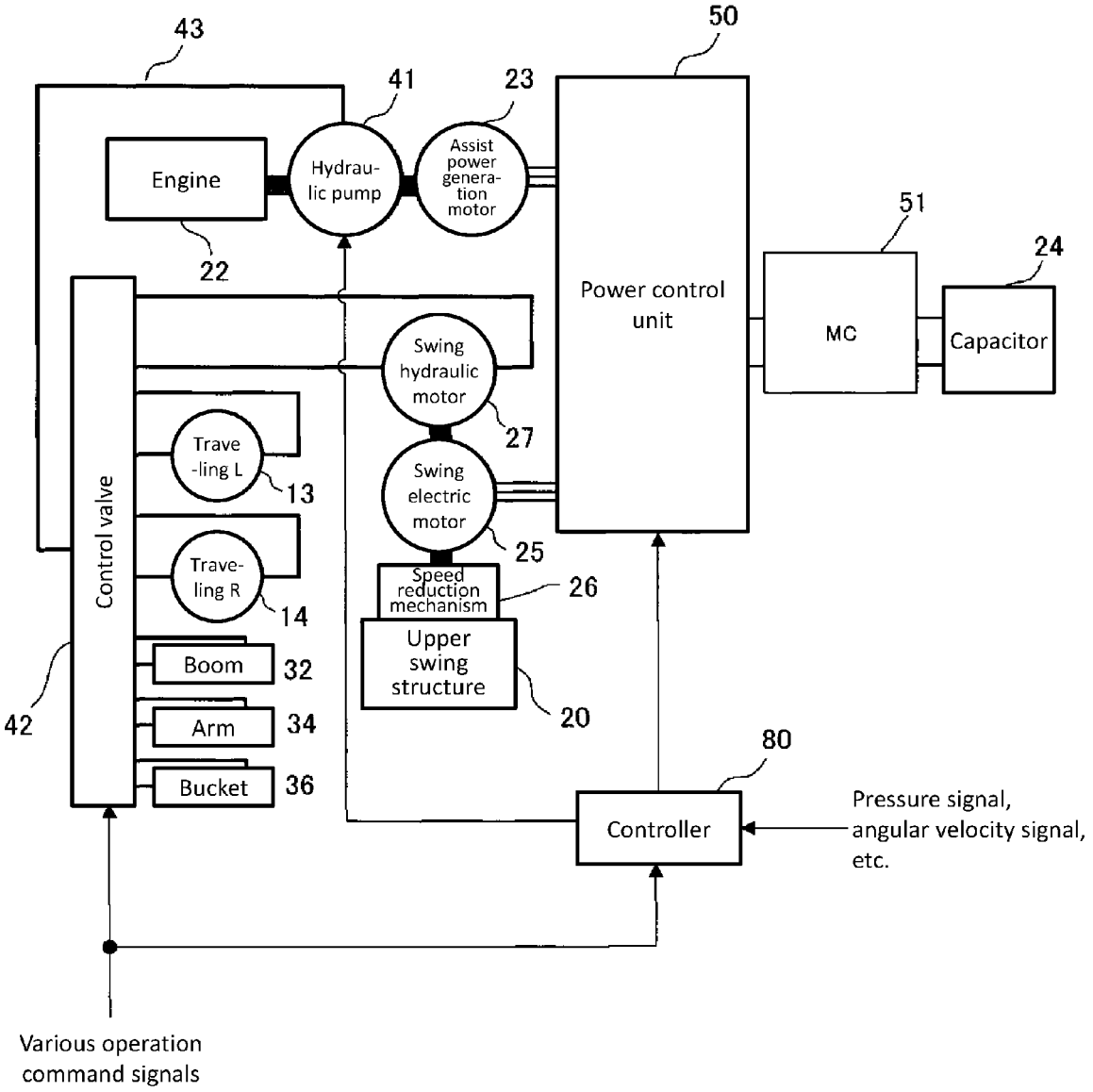
FIG. 2 is a conceptual diagram of a drive system provided in the construction machine according to the first embodiment of the present invention.

FIG. 2 is a conceptual diagram of the drive system provided in the construction machine according to the first embodiment of the present invention.

As illustrated in the diagram, the hydraulic system 40 includes a hydraulic pump 41 as a hydraulic fluid source for generating hydraulic pressure, and a control valve 42 for drive control of each of the hydraulic actuators. The hydraulic pump 41 is driven by an engine 22. The control valve 42 operates a swing spool 61 (see FIG. 3) according to a swing operation command (hydraulic pilot signal) from a swing operation system 72 (see FIG. 3), so as to control the flow rate and direction of hydraulic fluid supplied to the swing hydraulic motor 27. In addition, the control valve 42 operates a boom spool 64 (see FIG. 3) according to a boom operation command (hydraulic pilot signal) from a boom operation system 78 (see FIG. 3), so as to control the flow rate and direction of hydraulic fluid supplied to the boom cylinder 32. Similarly, though not specifically illustrated in the diagram, the control valve 42 operates spools corresponding to operation commands (hydraulic pilot signals) from other operation lever systems according to the operation commands, so as to control the flow rates and directions of hydraulic fluids supplied respectively to the arm cylinder 34, the bucket cylinder 36 and the traveling hydraulic motors 13 and 14. The various operation systems including the swing operation system 72 and the boom operation system 78 are disposed in a cabin of the track structure 20.

In addition to the aforementioned capacitor 24, the electric system includes a power control unit 50 and a main contactor 51, etc. The power control unit 50 is connected with the assist power generation motor 23 and the swing electric motor 25, and is connected to the capacitor 24 through the main contactor 51. The capacitor 24 is discharged or charged according to the drive conditions (whether in a power running or in a regenerative running) of the assist power generation motor 23 and the swing electric motor 25. The drive conditions of the assist power generation motor 23 and the swing electric motor 25 are controlled by the power control unit 50 in accordance with commands from a controller 80.

The controller 80 generates control commands for the control valve 42, the hydraulic pump 41, and the power control unit 50 on the basis of various input signals, and performs torque control on the swing electric motor 25, delivery flow rate control on the hydraulic pump 41, and the like. Input signals to the controller 80 include operation signals from various operation systems, a pressure detection signal from the swing hydraulic motor 27, and an angular velocity signal from the swing electric motor 25.

Figure 3:
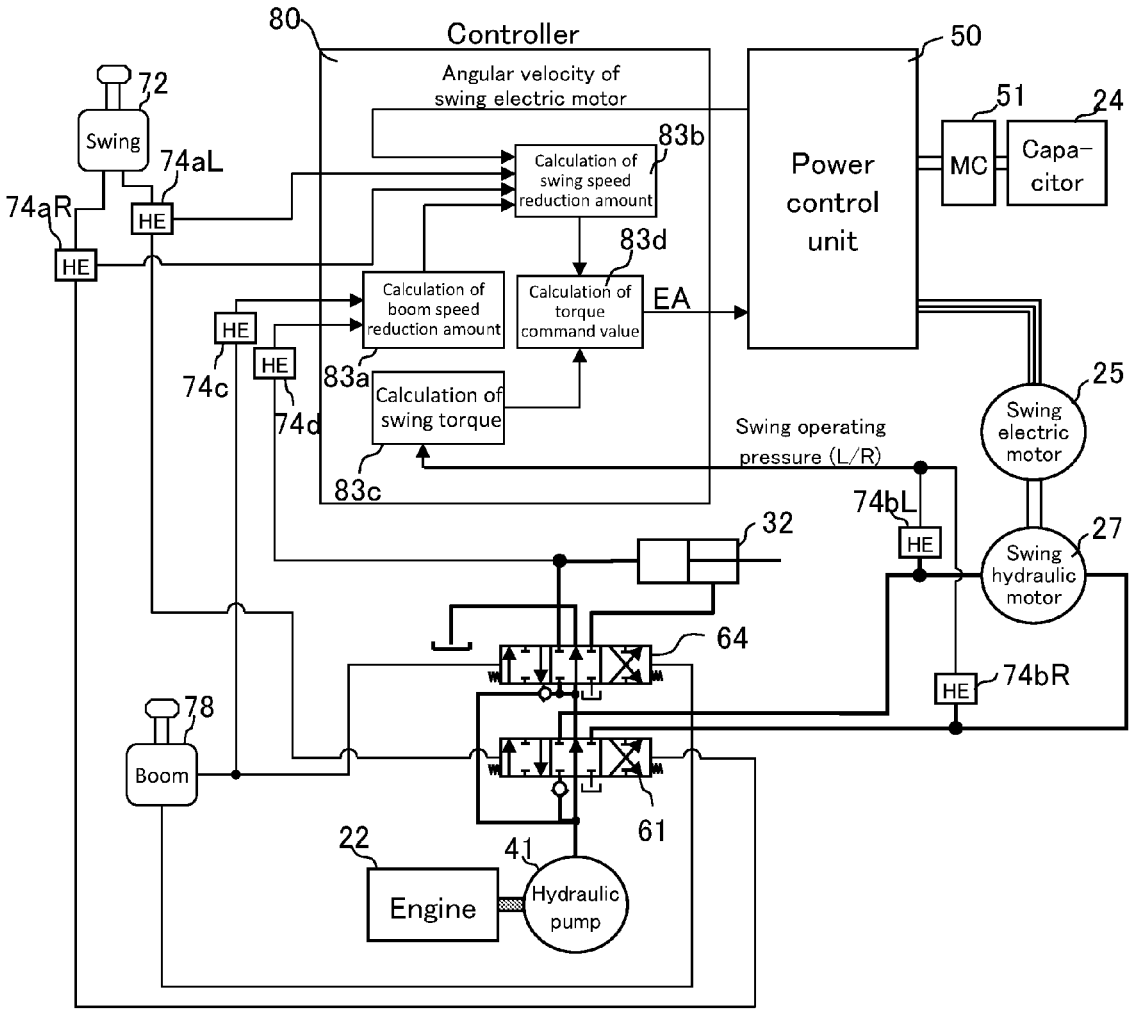
FIG. 3 is a block diagram of an essential part of the drive system provided in the construction machine according to the first embodiment of the present invention.

FIG. 3 is a block diagram of an essential part of the drive system provided in the construction machine according to the first embodiment of the present invention.

As shown in the diagram, the controller 80 includes a boom speed reduction amount calculation block 83*a* (boom speed reduction amount calculation section), a swing speed reduction amount calculation block 83*b* (swing speed reduction amount calculation section), a swing torque calculation block 83*c* (swing torque calculation section), and a torque command value calculation block 83*d* (torque command value calculation section). Besides, a pilot line of the swing operation system 72 is provided with detectors 74*a*L and 74*a*R, and both of lines for suction and discharge of hydraulic fluid into and from the swing hydraulic motor 27 are provided with detectors 74*b*L and 74*b*R, respectively. A pilot line of the boom operation system (boom operation lever system) 78 is provided with a detector 74*c*, and a line for suction and discharge of hydraulic fluid into and from a bottom-side fluid chamber of the boom cylinder 32 is provided with a detector 74*d*.

Each of the detectors 74*a*L, 74*a*R, 74*b*L, 74*b*R, 74*c* and 74*d* is a hydraulic-to-electric converter for converting a pressure in a hydraulic line into an electrical signal, and outputs a signal to the controller 80. Specifically, the detector 74*a*L convers into an electrical signal a hydraulic pilot signal generated by an operation input to the swing operation system 72 at the time of instructing a leftward swing operation, and outputs the electrical signal as a detection signal to the swing speed reduction amount calculation block 83*b*. The detector 74*a*R converts into an electrical signal a hydraulic pilot signal generated by an operation input to the swing operation system 72 at the time of instructing a rightward swing operation, and outputs the electrical signal as a detection signal to the swing speed reduction amount calculation block 83*b*. The detectors 74*b*L and 74*b*R convert an operation pressure in the swing hydraulic motor 27 into an electrical signal, and output the electrical signal as a detection signal to the swing torque calculation block 83*c*. The detector 74*c* convers into an electrical signal a hydraulic pilot signal generated by an operation input to the boom operation system 78 at the time of instructing a boom raising operation, and outputs the electrical signal as a detection signal to the boom speed reduction amount calculation block 83*a*. The detector 74*d* converts a bottom pressure in the boom cylinder 32 into an electrical signal, and outputs the electrical signal as a detection signal to the boom speed reduction amount calculation block 83*a*.

The boom speed reduction amount calculation block 83*a* calculates a speed reduction amount of boom speed (boom speed reduction amount) ΔR with respect to a reference boom raising speed Rs that is suited to an operation amount of the boom operation system 78, based on the signals from the detectors 74*c* and 74*d*. The reference boom raising speed Rs means a speed at which the boom 31 is raised according to an operation amount of the boom operation system 78 in a no-load condition (a condition where the bucket is empty) or a condition where a predetermined load is exerted. In the boom speed reduction amount calculation block 83*a*, a relation (a relation curve, a table or the like) between boom raising operation amount (the signal from the detector 74*c*) of the boom operation system 78 and the reference boom raising speed Rs is preliminarily stored. In addition, in the boom speed reduction amount calculation block 83*a*, relations (relation curves, tables or the like) between the boom raising operation amount (the signal from the detector 74*c*) of the boom operation system 78, bottom pressure (the signal from the detector 74*d*) of the boom cylinder 32, and the boom speed reduction amount ΔR are preliminarily stored. In the boom speed reduction amount calculation block 83*a*, therefore, on the basis of the signals from the detectors 74*c* and 74*d*, the reference boom raising speed Rs suited to the operation amount of the boom operation system 78 is calculated, and, simultaneously, the boom speed reduction amount ΔR according to the bottom pressure of the boom cylinder 32 is calculated. These calculated values are inputted from the boom speed reduction amount calculation block 83*a* to the swing speed reduction amount calculation block 83*b*. Note that it may also be contemplated to let the boom speed reduction amount AR be a value determined simply by the relation with the bottom pressure of the boom cylinder 32.

The swing speed reduction amount calculation block 83*b* calculates a speed reduction amount of swing speed (swing speed reduction amount) ΔS with respect to a reference swing speed Ss that is suited to an operation amount of the swing operation system 72, based on the calculated boom speed reduction amount ΔR and the signals from the detectors 74*a*L and 74*a*R. The reference swing speed Ss means an intrinsic speed according to the operation amount of the swing operation system 72. In addition, when boom raising speed R (=Rs−ΔR) determined taking the boom speed reduction amount ΔR into account and swing speed S (=Ss−ΔS) determined taking the swing speed reduction amount ΔS into account are used, a relation of R/S=Rs/Ss is established. In other words, the swing speed reduction amount ΔS is a correction amount that should be subtracted from the reference swing speed Ss in such a manner that the excavator mechanism 30 will move along a locus that is to be described by the excavator mechanism 30 driven at the reference boom raising speed Rs and the reference swing speed Ss, in the case where a boom speed reduction amount ΔR is anticipated due to a boom load. The swing speed reduction amount ΔS is inputted from the swing speed reduction amount calculation block 83*b* to the torque command value calculation block 83*d*. Note that during control of swing speed, the swing speed reduction amount calculation block 83*b* regulates the value of the speed reduction amount ΔS in such a manner that an actual swing speed calculated based on an angular velocity signal co of the swing electric motor 25 inputted through the power control unit 50 will approach the swing speed S (target).

In the swing torque calculation block 83*c*, swing torque of the swing hydraulic motor 27 is calculated based on the signals from the detectors 74*b*L and 74*b*R, and the calculated value is outputted to the torque command value calculation block 83*d*. In the torque command value calculation bock 83*d*, on the basis of the swing speed reduction amount ΔS calculated by the swing speed reduction amount calculation block 83*b* and the swing torque calculated by the swing torque calculation block 83*c*, a torque command value EA for the swing electric motor 25 that is necessary for generating the swing speed reduction amount ΔS is calculated, and the calculated value is outputted to the power control unit 50. The power control unit 50 drives the swing electric motor 25 in accordance with the torque command value EA. In this case, the swing electric motor 25 is driven as a generator, and a generation output obtained by regeneration of kinetic energy of the swing structure 20 is accumulated into the capacitor 24 by way of the main contactor 51.

Simultaneously with the load command given to the swing electric motor 25, a hydraulic pilot signal generated due to an input to the swing operation system 72 is inputted also to the control valve 42. As a result, the spool 61 is changed over from a neutral position, and hydraulic fluid delivered from the hydraulic pump 41 is supplied to the swing hydraulic motor 27, to cause driving of the swing hydraulic motor 27. Since the swing electric motor 25 and the swing hydraulic motor 27 are connected directly to each other, a total torque of the torques outputted from these motors 35 and 37 becomes a swing torque that actually acts on the swing structure 20.

In addition, at the time of a swing and boom raising operation, a hydraulic pilot signal generated due to an operation input to the boom operation system 78 simultaneously with the above-mentioned swing drive is inputted also to the control valve 42. As a result, the spool 64 is changed over from a neutral position, hydraulic fluid delivered from the hydraulic pump 41 is supplied to the boom cylinder 32, and the boom 31 is raised.

FIG. 13 is a chart in which conditions for generating the aforementioned load torque are summarized.

As shown in the chart, suppression of swing speed (in this embodiment, regeneration by the swing electric motor 25) is performed only at the time of a swing and boom raising operation. In other words, the suppression of swing speed is conducted only in the case where a boom raising operation and a swing operation are simultaneously performed, and the swing speed is not suppressed not only in the case where neither a boom raising operation nor a swing operation is performed but also in the case where only one of these operations is performed. In addition, the operation of raising the swing boom includes, for example, a case where it is unnecessary to suppress the swing speed because, for example, the bucket 35 is empty. In such a case, in order to avoid an unnecessary lowering in the swing speed, it may be preferable, for example, to add a condition where the bottom pressure of the boom cylinder 32 is in excess of a holding pressure of the excavator mechanism 30 to the conditions for the suppression. In other words, a configuration is adopted wherein the swing speed is suppressed only in the case where the bottom pressure of the boom cylinder 32 is in excess of the holding pressure and where a boom raising operation and a swing operation are simultaneously performed. In this case, the suppression of the swing speed is not conducted when the bottom pressure of the boom cylinder 32 is not more than the holding pressure, even if a boom raising operation and a swing operation are simultaneously performed.

Note that the holding pressure of the excavator mechanism 30 is the bottom pressure of the boom cylinder 32 in a condition where the bucket 36 in an empty state is floated in the air and only the weight of the excavator mechanism 30 is acting on a bottom-side fluid chamber of the boom cylinder 32. Besides, in the block configuration shown in FIG. 3, performing the suppression of the swing speed is identical, on a meaning basis, to calculating the value of the swing speed reduction amount ΔS as a non-zero value in the swing speed reduction amount calculation block 83*b*. In the case where the suppression of the swing speed is not conducted, the swing speed reduction amount calculation block 83*b* does not calculate the swing speed reduction amount ΔS or calculates it as zero.

Figure 4:
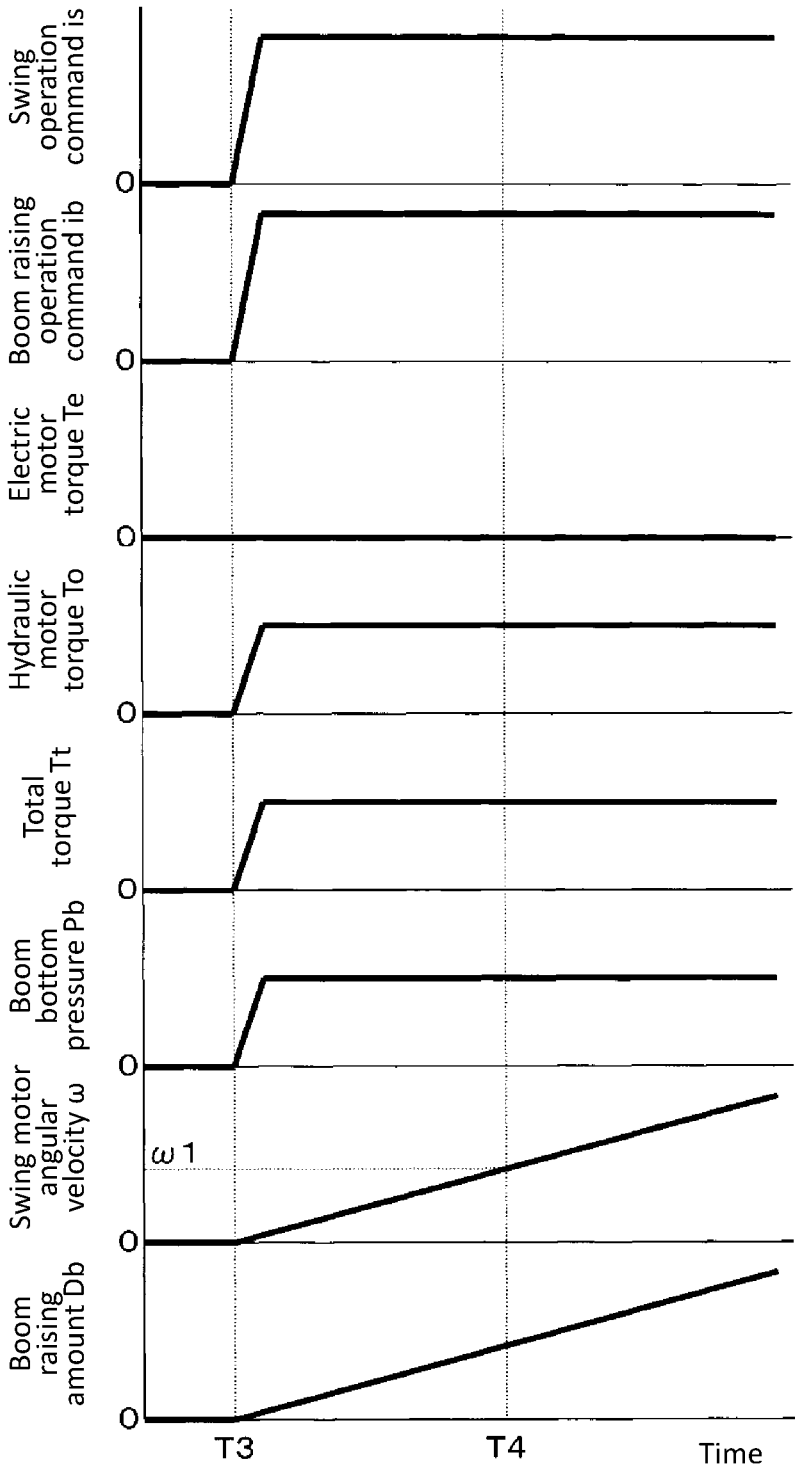
FIG. 4 is a diagram showing behaviors of torque and the like at the time of a swing and boom raising operation in the case where no load is present on a boom in the construction machine according to the first embodiment of the present invention.

FIG. 4 is a diagram showing behaviors of torque and the like at the time of a swing and boom raising operation in a case where boom load is absent (in the case where the bucket 35 is empty).

As shown in the diagram, a swing operation command "is" and a boom raising operation command "ib" are simultaneously inputted at time T3. In this example, however, the given condition is that the bottom pressure of the boom cylinder 32 is equal to the holding pressure of the excavator mechanism 30, and boom load is absent. Therefore, a load torque Te due to the swing electric motor 25 is not generated (not regenerated). Accordingly, the swing torque To generated by the swing hydraulic motor 27 becomes a total torque Tt of the swing electric motor 25 and the swing hydraulic motor 27. As a result, swing speed of the swing structure 20 increases gradually, so that angular velocity reaches ω1 at time T4 in this example. On the other hand, in response to the input of the boom raising operation command "ib," working fluid is supplied into the bottom-side fluid chamber of the boom cylinder 30, the bottom pressure Pb of the boom cylinder 32 rises, and the boom 31 of the excavator mechanism 30 is rotated upward. Thus, a swing operation of the swing structure 20 and the rising operation of the excavator mechanism 30 are simultaneously performed, whereby a swing and boom raising operation is carried out. Note that the boom raising speed and the swing speed under the conditions in this example correspond to the aforementioned reference boom raising speed and reference swing speed, respectively.

Figure 5:
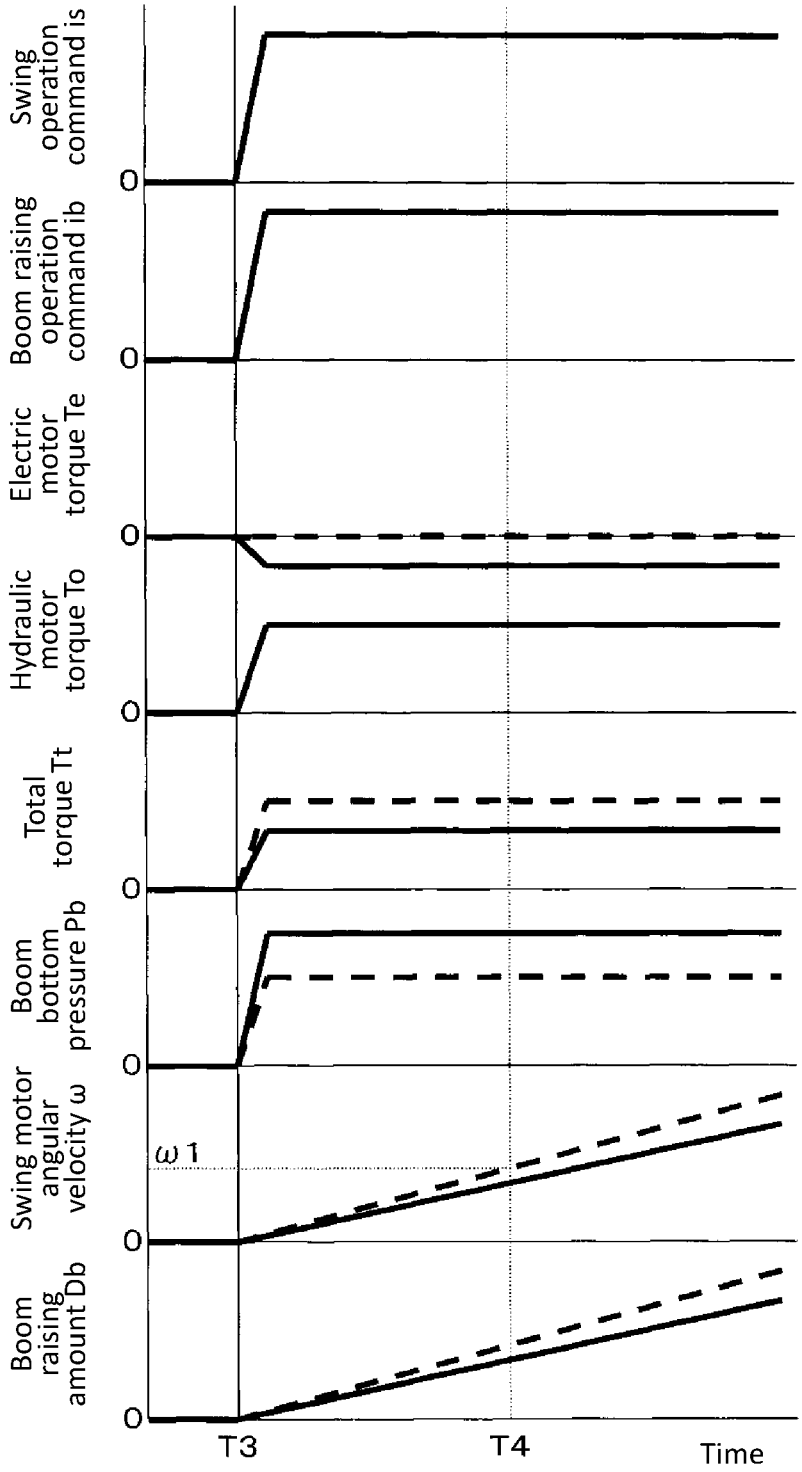
FIG. 5 is a diagram showing behaviors of torque and the like at the time of a swing and boom raising operation in the case where a load is present on the boom in the construction machine according to the first embodiment of the present invention.

FIG. 5 is a diagram showing behaviors of torque and the like at the time of a swing and boom raising operation in a case where a boom load is present (in a case where a load is present in the bucket 35). Broken lines in the diagram represent the torque and the like in the case where boom load is absent (FIG. 4). It is assumed that the behaviors of the swing operation command "is" and the boom raising operation command "ib" are the same as in FIG. 4.

As shown in the diagram, in response to the input of the boom raising operation command "ib," working fluid is supplied into the bottom-side fluid chamber of the boom cylinder 32, and the bottom pressure Pb of the boom cylinder 32 rises; in this case, the bottom pressure Pb becomes higher than in the case of FIG. 4 by an amount corresponding to the boom load. As a result, rise amount Db of the boom 31 within the same time is smaller than in the case of FIG. 4.

On the other hand, since the boom load is present in this example, upon the simultaneous input of the swing operation command "is" and the boom raising operation command "ib," a load torque Te due to the swing electric motor 25 is generated (regenerated). Therefore, the swing torque To of the swing hydraulic motor 27 is partly canceled, so that the total torque Tt is reduced by an amount corresponding to the load torque Te as compared to the case where boom load is absent. Consequently, the swing speed of the swing structure 20 is suppressed, and the angular velocity at time T4 is less than ω1.

As a result, where the swing operation amount and the boom raising amount are the same, the swing speed in the example of FIG. 5 is suppressed by an amount of lowering in the rising speed of the boom 31. Therefore, although the speed is lowered in correspondence with the boom load, the excavator mechanism 30 is moved while describing a locus similar to that in the example of FIG. 4.

Second Embodiment

Figure 6:
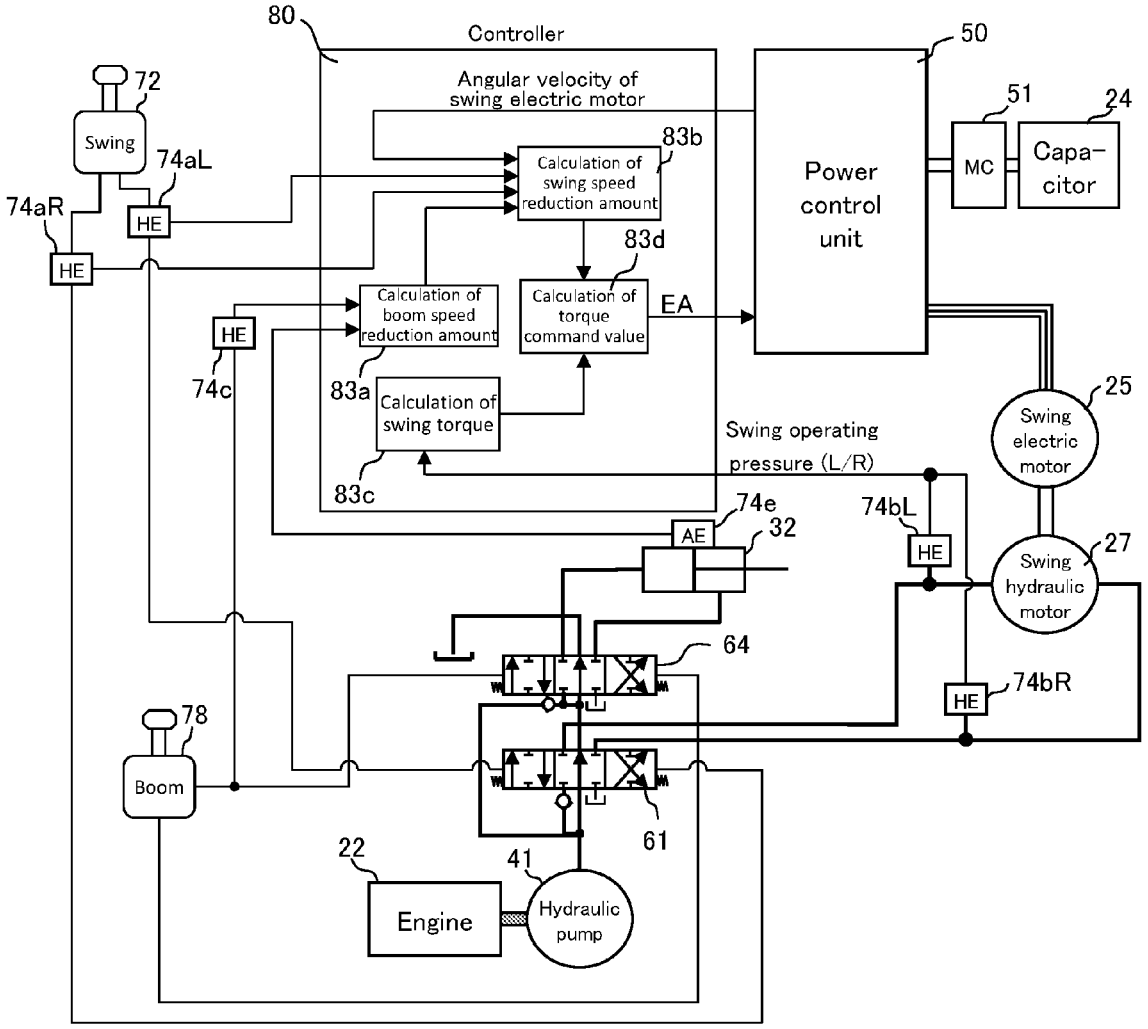
FIG. 6 is a block diagram of an essential part of a drive system provided in a construction machine according to a second embodiment of the present invention.

FIG. 6 is a block diagram of an essential part of a drive system provided in a construction machine according to a second embodiment of the present invention, and corresponds to FIG. 3 of the first embodiment. In FIG. 6, the same parts as in the first embodiment are denoted by the same reference symbols as in the preceding drawings, and descriptions of them are omitted.

As shown in FIG. 6, in this embodiment, the boom cylinder 32 is provided with a stroke sensor 74*e*, and a signal from the stroke sensor 74*e* is outputted to the boom speed reduction amount calculation block 83*a* of the controller 80.

Figure 7:
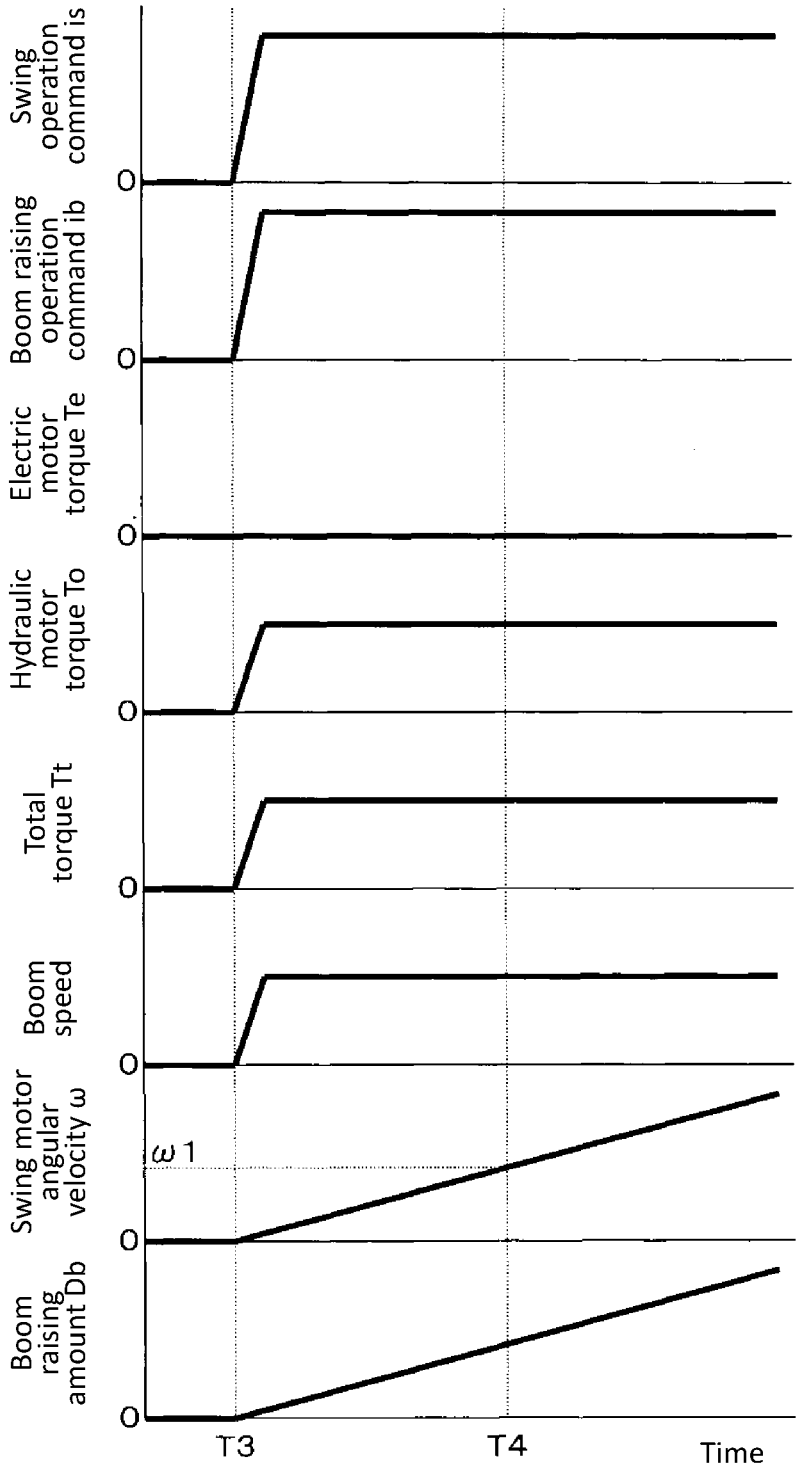
FIG. 7 is a diagram showing behaviors of torque and the like at the time of a swing and boom raising operation in the case where no load is present on a boom in the construction machine according to the second embodiment of the present invention.
Figure 8:
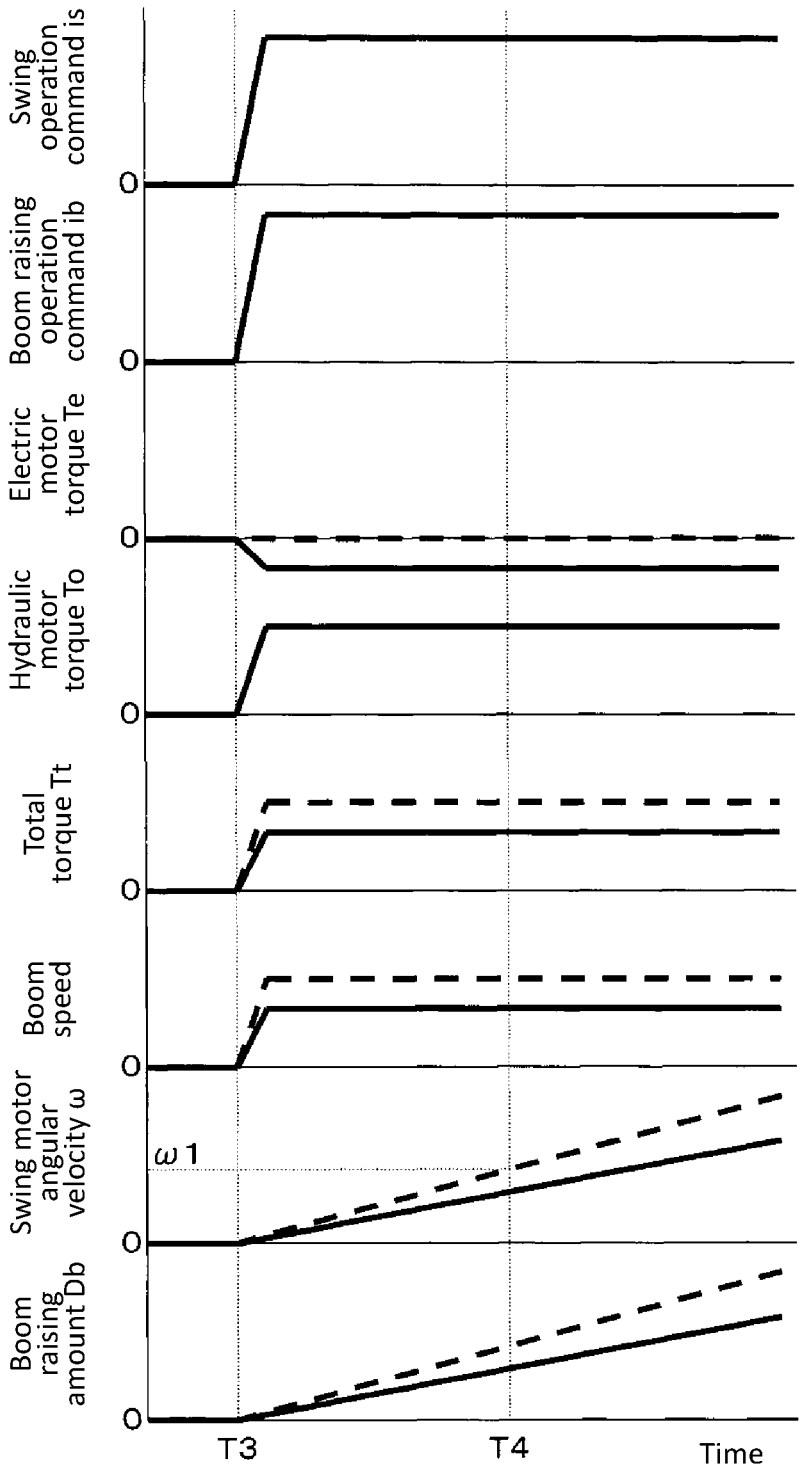
FIG. 8 is a diagram showing behaviors of torque and the like at the time of a swing and boom raising operation in the case where a load is present on the boom in the construction machine according to the second embodiment of the present invention.

FIG. 7 is a diagram showing behaviors of torque and the like at the time of a swing and boom raising operation in a case where boom load is absent (in a case where the bucket 35 is empty), and FIG. 8 is a diagram showing behaviors of torque and the like at the time of a swing and boom raising operation in a case where a boom load is present (in a case where a load is present in the bucket 35). These figures correspond to FIG. 4 and FIG. 5 of the first embodiment.

As shown in these diagrams, when a boom raising operation command "ib" is inputted at time T3, the boom cylinder 32 is extended. The extending speed (boom speed) in the case where a boom load is present is slower than the speed (solid line in FIG. 7; broken line in FIG. 8) in the case where boom load is absent. In this example, a speed reduction amount with respect to the reference boom raising speed is calculated by the boom speed reduction amount calculation block 83*a*, based on the signal from the stroke sensor 74*e*. This embodiment is the same as the first embodiment in the other points inclusive of the contents of processes in each block of the controller 80, and the behaviors of torques and the like in response to operation inputs.

Third Embodiment

Figure 9:
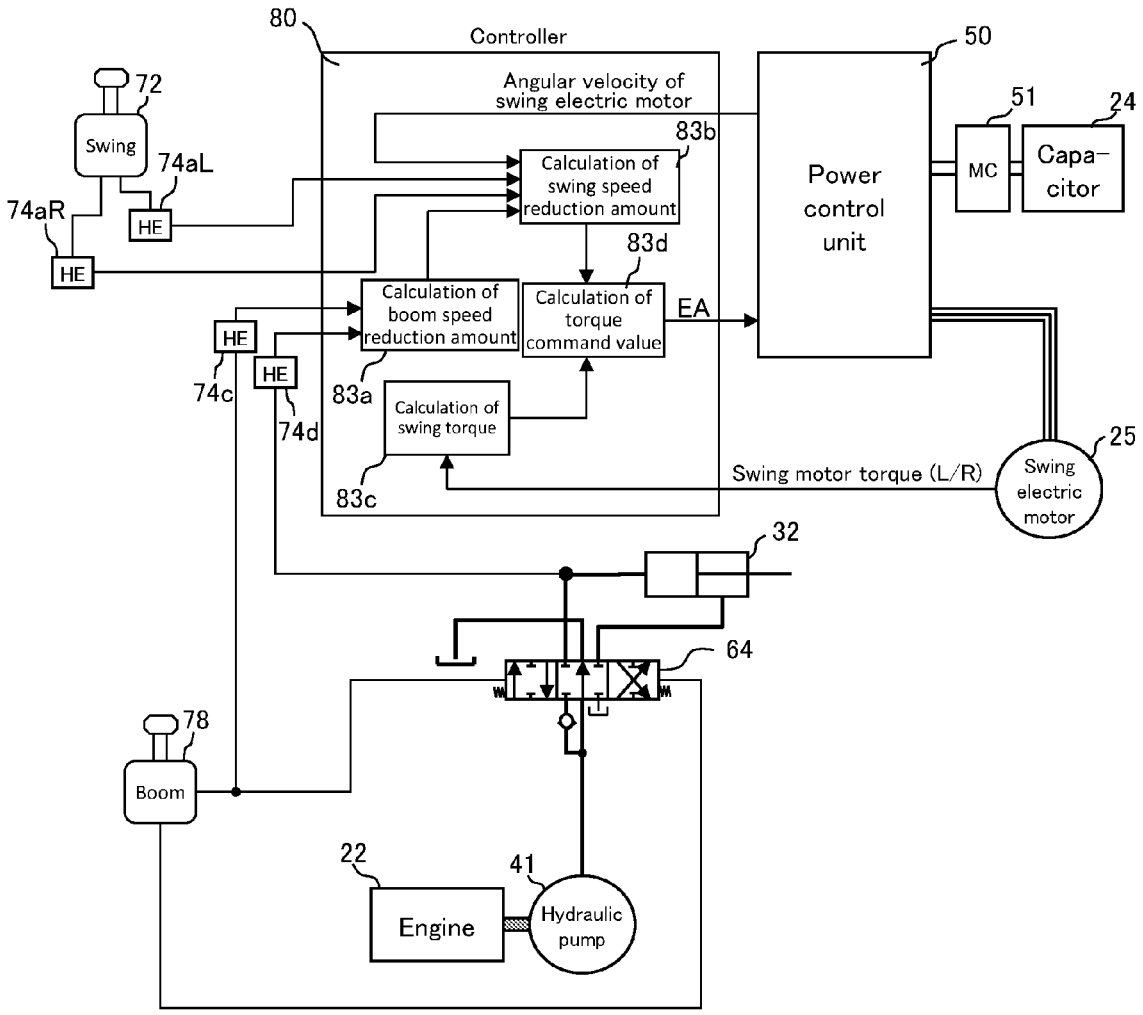
FIG. 9 is a block diagram of an essential part of a drive system provided in a construction machine according to a third embodiment of the present invention.

FIG. 9 is a block diagram of an essential part of a drive system provided in a construction machine according to a third embodiment of the present invention, and corresponds to FIG. 3 and FIG. 6 of the aforementioned embodiments. In FIG. 9, the same parts as in the above-described embodiments are denoted by the same reference symbols as in the preceding drawings, and descriptions of them are omitted.

As shown in FIG. 9, the hydraulic excavator according to this embodiment does not have a swing hydraulic motor 27, but is configured to drive and swing the swing structure 20 by only the swing electric motor 25. Therefore, in the control valve 42, a spool 61 corresponding to the swing hydraulic motor 27 and detectors 74*b*L and 74*b*R (see FIG. 3 for both) for detecting an operation pressure of the spool 61 are absent. In this embodiment, a torque signal is inputted from the swing electric motor 25 to the swing torque calculation block 83*c*, and, in the swing torque calculation block 83*c*, a swing torque of the swing electric motor 25 is calculated based on the signal from the swing electric motor 25.

In addition, in this embodiment, unlike in the aforementioned embodiments, regenerative drive of the swing electric motor 25 is not conducted at the time of giving swing power to the swing structure 20. At the time of giving swing power to the swing structure 20, power running drive of the swing electric motor 25 is performed constantly, independently of a boom load. For instance, in the torque command value calculation block 83*d*, a swing torque (torque correction amount ΔT) to be reduced for reducing the swing speed with respect to the reference swing speed Ss by a swing speed reduction amount ΔS calculated by the swing speed reduction amount calculation block 83*b* is calculated, a value obtained by subtracting the torque correction amount ΔT from a torque calculated by the swing torque calculation block 83*c* is generated, and the thus generated value is outputted to the power control unit 50. As a result, at the time of a boom raising operation, power running drive of the swing electric motor 25 is performed with a swing torque according to the boom load, and the swing structure 20 is driven to swing at a swing speed determined taking the swing speed reduction amount ΔS into account. Naturally, the conditions for performing suppression of swing speed (for a swing speed reduction amount AS having a non-zero value to be inputted to the torque command value calculation block 83*d*) are the same as in the preceding embodiments.

While the case of applying the present invention to a hydraulic excavator provided with an electric motor 25 and a hydraulic motor 27 for swing has been shown in describing the first and second embodiments, the present invention is also applicable to a hydraulic excavator in which a swing hydraulic motor 27 is omitted and swing drive is effected by only an electric motor 25 as in this embodiment.

Fourth Embodiment

Figure 10:
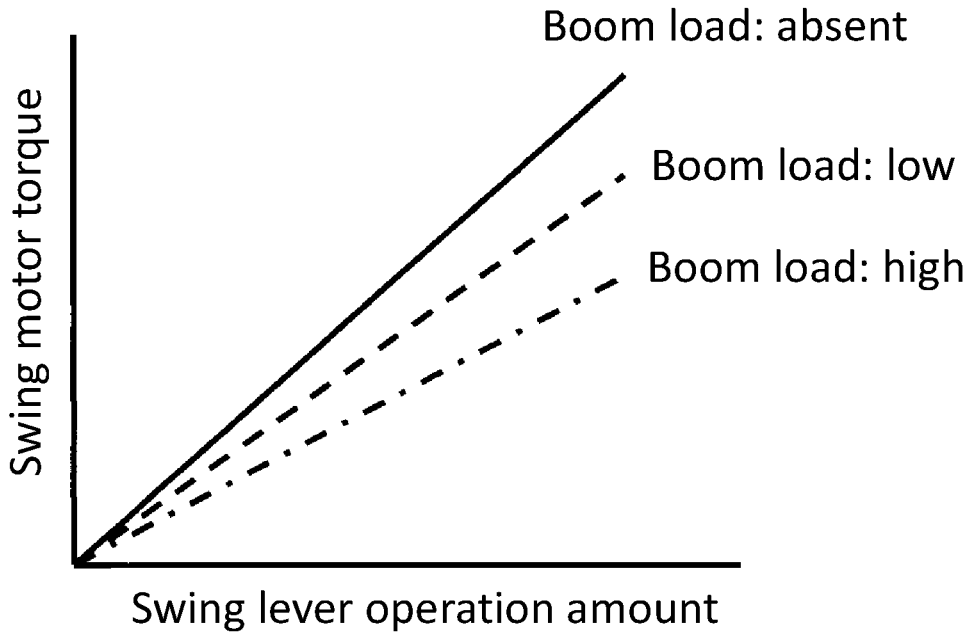
FIG. 10 is a characteristic chart showing an example of the relation between swing motor torque and swing angular velocity and the like at the time of a swing and boom raising operation in the construction machine according to the third embodiment of the present invention.

In the first to third embodiments, a configuration has been adopted in which a swing speed reduction amount AS according to a boom speed reduction amount AR is calculated and the swing torque is corrected thereby. There may also be considered a configuration in which a target swing torque is calculated based on a boom load and a swing operation amount, for example, in performing suppression of swing speed. In this case, for example as shown in FIG. 10, relations between swing operation amount and swing torque are preset on the basis of boom load, and these relations are preliminarily stored in the torque command value calculation block 83*d*. In addition, signals from detectors 74*a* and 74*d* are inputted to the torque command value calculation block 83*d*. With this configuration, a swing torque as a target is calculated in the torque command value calculation block 83*d* on the basis of an operation amount of the swing lever system 72 and a boom load. In the case where this technical thought is combined with the first and second embodiments, the difference between a swing torque calculated by the swing torque calculation block 83*c* and a target value is calculated as a command value (load torque) for regenerative drive of the swing electric motor 25, and is outputted to the power control unit 50. In the case where the technical thought is combined with the third embodiment, a value obtained by correcting the swing torque calculated by the swing torque calculation block 83*c* on the basis of a target value is calculated as a command value for power running drive of the swing electric motor 25, and is outputted to the power control unit 50.

Note that FIG. 10 shows only three relation curves "boom load: absent," "bool load: low" and "boom load: high," the parameters of boom load are set more precisely, and the relation curves are present in the number corresponding to the number of settings of boom load. In the swing speed reduction amount calculation block 83*b*,

Effect

Figure 11:
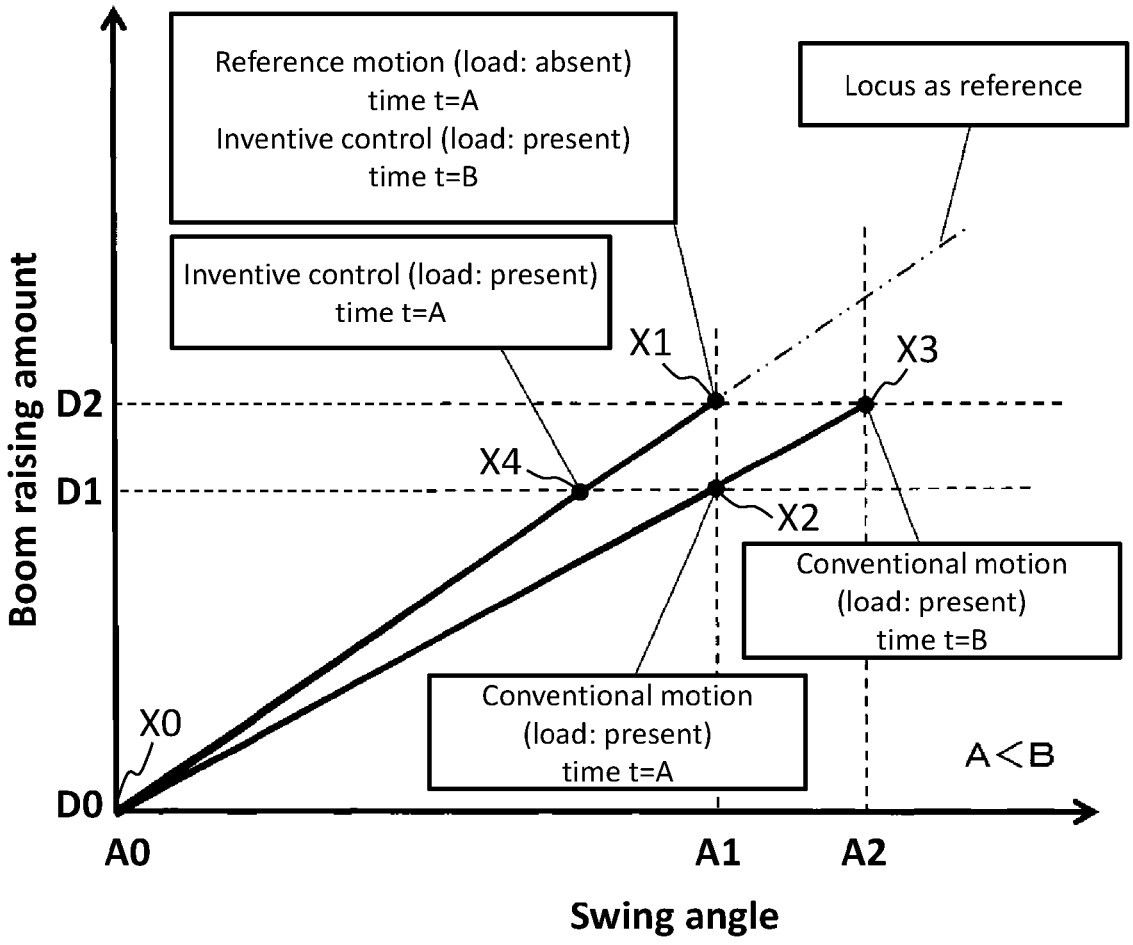
FIG. 11 is a diagram showing differences in locus of a boom due to boom load at the time of a swing and boom raising operation, for explaining the effect of the present invention.

FIG. 11 is a diagram for explaining the effect of the present invention.

In the diagram, the axis of abscissas represents swing angle of the swing structure 20 from the start of swing at the time of a swing and boom raising operation, and the axis of ordinates represents a rising amount of the boom 31 from the start of boom raising at the time of a swing and boom raising operation. A case is considered in which when a swing and boom raising operation is conducted with a predetermined swing operation amount and a predetermined boom raising operation amount in the absence of boom load, the boom 31 (for example, the tip thereof) is moved from position X0 (A0, D0) to position X1 (A1, D2) when time A elapses from the start of operation. In other words, this is an example in which the boom 31 is raised at a reference boom raising speed Rs while performing swing drive at a reference swing speed Ss, and a line passing through position X0 and position X1 is made to be an example of reference locus (see alternate long and two short dashes line).

However, in a configuration wherein the swing structure 20 swings according to an operation amount and independently of boom load at the time of a swing and boom raising operation, a problem as follows would be generated if the same operation as above is conducted. With the elapse of time A, the swing angle reaches A1 but the boom 31 reaches only D1 (<D2), so that the boom position after time A is position X2, which is below position X1. If the height of the boom 31 must reach D2 for dumping a load in the bucket 35 onto a carrier of a transportation vehicle such as a dump truck, it would be impossible to carry out the dumping operation at position X2. With the swing and boom raising operation continued thereafter, the height of the boom 31 reaches D2 when time B (>A) elapses from the start of operation, but, in this case, the swing angle reaches A2 (>A1). In other words, the boom 31 reaches position X3 at height D2 along a locus that is lower than the reference locus (alternate long and two short dashes line). Therefore, if the swing and boom raising operation by the operator is intended to attain the reference locus, the locus passing through position X2 is an unexpectedly lower locus, so that the excavator mechanism 30 can possibly collide against the carrier of the transportation vehicle.

In each of the aforementioned embodiments, on the other hand, the swing speed at the time of a swing and boom raising operation is suppressed in the case where a boom load is present, and, accordingly, the boom 31 is moved along the reference locus if the same operation is conducted. Since both the boom raising speed and the swing speed are lowered as compared to the case where boom load is absent, the boom is still at position X4 (height D1 <D2) when time A elapses, but the boom reaches position X1 after time B elapses from the start of operation.

Thus, according to each of the above embodiments, in the case where boom load is high, the moving speed of the boom 31 is lowered correspondingly, so that a natural operation feeling can be realized. Nevertheless, since the swing speed is lowered according to a lowering in the moving speed of the boom 31, it is possible to inhibit an unintended trouble such as collision of the excavator mechanism 30 against the carrier of a transportation vehicle due to movement of the boom 31 along an unexpectedly lower locus. In addition, although the speed varies according to boom load, the boom moves along the reference locus independently of the boom load. Therefore, even an unskillful person can move the boom 31 along a stable locus without being affected by variations in boom load during operation.

Figure 12:
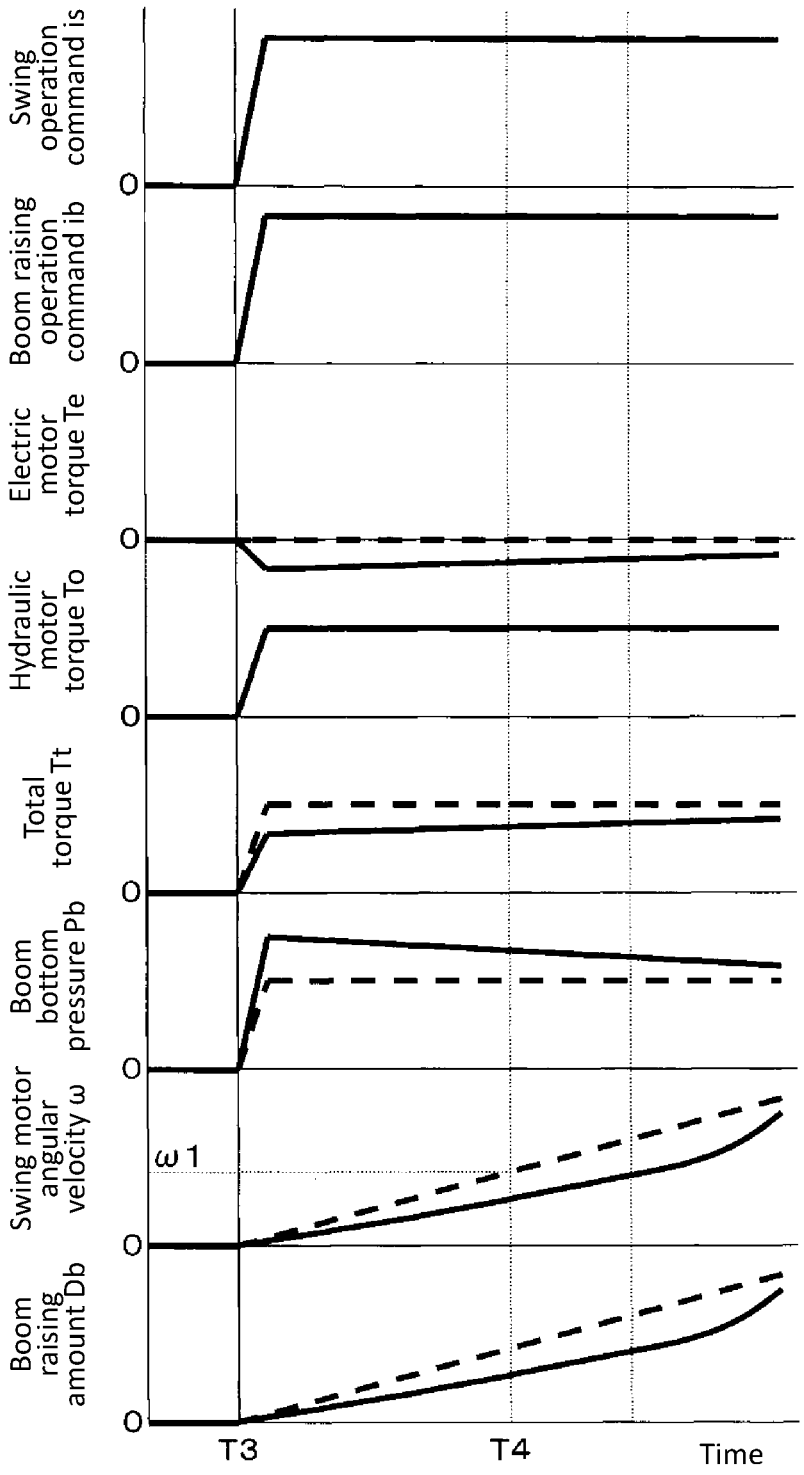
FIG. 12 is a diagram showing behaviors of torque and the like at the time of a swing and boom raising operation in a construction machine according to the present invention in the case where boom load during operation varies.

Note that strictly speaking, the load pressure on the boom cylinder 32 varies according to the posture of the boom 31. In each of the above embodiments, however, reduction rate of swing torque varies with variation in the boom load during a swing and boom raising operation. An example of behaviors of torque and the like as determined taking into account the variation in boom load during a swing and boom raising operation is shown in FIG. 12. As shown in the figure, even where boom raising operation command "ib" is constant, bottom pressure Pb (solid line) of the boom cylinder 32 varies with variation in the posture of the boom 31. Since the reduction amounts calculated by the boom speed reduction amount calculation block 83*a* and the swing speed reduction amount calculation section 83*b* are also varied following up to variation in the boom load, however, reduction rate of swing angular velocity co is also varied in conformity to variation in reduction rate of the boom raising amount Db. As a result, the deviation of the locus described by the boom 31 from the reference locus can be suppressed (variations in Db/ω can be suppressed).

In addition, in the aforementioned first and second embodiments, a power generation output can be obtained by performing regenerative drive of the swing electric motor 25 at the time of reducing the swing speed, and, accordingly, energy efficiency is enhanced.

In the fourth embodiment, on the other hand, calculations of the swing speed reduction amount AS and the boom speed reduction amount AR can be omitted, and, accordingly, there is a merit that algorithm can be simplified as compared to the other embodiments.

Others

While a case of applying the present invention to a hydraulic excavator has been taken as an example in the description of each of the above embodiments, the present invention is applicable generally to construction machines including a work implement capable of being raised and lowered and a swing structure. The invention is also applicable to other construction machines such as crane vehicle having a crane (work implement) and a swing structure.

DESCRIPTION OF REFERENCE CHARACTERS

10: Track structure
11: Crawlers
12: Crawler frame
13: Right traveling hydraulic motor
14: Left traveling hydraulic motor
20: Swing structure
21: Swing frame
22: Engine
23: Assist power generation motor
24: Capacitor
25: Swing electric motor
26: Speed reduction gear
27: Swing hydraulic motor
30: Excavator mechanism
31: Boom
32: Boom cylinder
33: Arm
35: Bucket
40: Hydraulic system
41: Hydraulic pump
42: Control valve
43: Hydraulic line
50: Power control unit
51: Main contactor
61: Swing spool
64: Boom spool
72: Swing operation system
78: Boom operation system
80: Controller
83*a:* Boom speed reduction amount calculation block (boom speed reduction amount calculation section)
83*b:* Swing speed reduction amount calculation block (swing speed reduction amount calculation section)
83*d:* Torque command value calculation block (torque command value calculation section)

The invention claimed is:

1. A construction machine comprising:
a track structure;
a swing structure provided on the track structure in a swingable manner;
a swing motor that drives and swings the swing structure;
a boom connected to the swing structure;
a boom cylinder that moves the boom vertically;
a swing operation system that instructs a swing operation of the swing structure;
a boom operation system that instructs a vertical movement of the boom;
a detector that detects a state quantity varying according to a load on the boom cylinder; and
a controller that reduces a swing speed of the swing structure according to a signal from the detector with respect to a reference swing speed according to a signal of the swing operation, while signals of the swing operation by the swing operation system and a boom raising operation by the boom operation system are being inputted,
wherein the controller includes:
a boom speed reduction calculation section configured to calculate a boom speed reduction amount AR with respect to a reference boom raising speed Rs that is suited to an operation amount of the boom operation system on the basis of the signal from the detector;
a swing speed reduction amount calculation section configured to calculate a swing speed reduction amount ΔS with respect to a reference swing speed Ss that is suited to an operation amount of the swing operation system on the basis of the operation amount of the swing operation system and the boom speed reduction amount ΔR; and
a torque command calculation section configured to calculate and output a swing motor torque command for generating the swing speed reduction amount ΔS on the basis of swing torque of the swing motor and the swing speed reduction amount ΔS, and
wherein the swing speed reduction amount calculation section calculates the swing speed reduction amount ΔS such that the relation of $(Rs-\Delta R)/(Ss-\Delta S)=Rs/Ss$ is established.

2. The construction machine according to claim 1,
wherein the swing motor includes a hydraulic motor and an electric motor, and
the controller outputs to the electric motor a power generation load command according to a detection signal of the detector.

3. The construction machine according to claim 1,
wherein the swing motor is an electric motor, and
the controller controls a revolving speed of the electric motor according to a detection signal of the detector.

4. The construction machine according to claim 1,
wherein the detector is a pressure sensor that detects a load pressure on the boom cylinder, and
the controller controls a revolving speed of the swing motor on the basis of a boom speed reduction amount calculated based on a signal from the pressure sensor.

5. The construction machine according to claim 1,
wherein the detector is a stroke sensor that detects variation in stroke of the boom cylinder, and
the controller controls the revolving speed of the swing motor on the basis of a boom speed reduction amount calculated based on a signal from the stroke sensor.

* * * * *